US009926149B2

(12) United States Patent
Thum

(10) Patent No.: US 9,926,149 B2
(45) Date of Patent: Mar. 27, 2018

(54) METHOD FOR HANDLING SHEET MATERIAL

(71) Applicant: CI Tech Components AG, Burgdorf (CH)

(72) Inventor: Xavier Thum, Wolfratshausen (DE)

(73) Assignee: CI Tech Components AG, Burgdorf (CH)

( * ) Notice: Subject to any disclaimer, the term of this patent is extended or adjusted under 35 U.S.C. 154(b) by 0 days.

(21) Appl. No.: 15/033,469

(22) PCT Filed: Oct. 20, 2014

(86) PCT No.: PCT/EP2014/072453

§ 371 (c)(1),
(2) Date: Apr. 29, 2016

(87) PCT Pub. No.: WO2015/062891

PCT Pub. Date: May 7, 2015

(65) Prior Publication Data

US 2016/0284152 A1 Sep. 29, 2016

(30) Foreign Application Priority Data

Oct. 30, 2013 (DE) ..... 10 2013 222 077

(51) Int. Cl.
*B65H 1/06* (2006.01)
*G07D 11/00* (2006.01)
(Continued)

(52) U.S. Cl.
CPC ..... *B65H 1/06* (2013.01); *B65H 1/24* (2013.01); *B65H 1/263* (2013.01); *B65H 7/12* (2013.01);
(Continued)

(58) Field of Classification Search
CPC . B65H 1/06; B65H 1/24; B65H 1/263; B65H 7/12; B65H 7/20; B65H 2405/10;
(Continued)

(56) References Cited

U.S. PATENT DOCUMENTS 5,076,441 A 12/1991 Gerlier
5,314,177 A 5/1994 Anma
(Continued)

FOREIGN PATENT DOCUMENTS

EP 0 379 638 A1 8/1990
WO WO 99/28226 A1 8/1990

OTHER PUBLICATIONS

International Search Report with Written Opinion for Application No. PCT/EP2014/072453 dated Mar. 18, 2015.
English Translation of the International Search Report with Written Opinion for Application No. PCT/EP2014/072453 dated Apr. 14, 2015.

*Primary Examiner* — David H Bollinger
(74) *Attorney, Agent, or Firm* — Jenkins, Wilson, Taylor & Hunt, P.A.

(57) ABSTRACT

In a method for handling sheet goods, in particular value documents, such as bank notes, in an apparatus for processing sheet goods, such as a bank-note machine, sheet goods are removed from a container for sheet goods that is inserted in the apparatus, through an output opening of the container, checked for further processability, and in the case of a negative check result returned into the container through an input opening of the container that is separate from the output opening. The container has a pressing device for exerting a pressure on the sheet goods in the direction of the output opening, wherein the pressing device is displaceable along the height of the container such that sheet goods are both outputtable from a sheet-goods region of the container through the output opening and inputtable back into the sheet-goods region through the input opening.

9 Claims, 2 Drawing Sheets

(51) Int. Cl.

| | |
|---|---|
| ***B65H 1/24*** | (2006.01) |
| ***B65H 1/26*** | (2006.01) |
| ***B65H 7/12*** | (2006.01) |
| ***B65H 7/20*** | (2006.01) |

(52) U.S. Cl.
CPC ..... *B65H 7/20* (2013.01); *G07D 11/0006* (2013.01); *G07D 11/0018* (2013.01); *G07D 11/0021* (2013.01); *B65H 2405/10* (2013.01); *B65H 2405/3322* (2013.01); *B65H 2701/1912* (2013.01)

(58) Field of Classification Search
CPC .... B65H 2405/3322; B65H 2701/1912; G07D 11/0006; G07D 11/0021; G07D 11/0018
See application file for complete search history.

(56) References Cited

U.S. PATENT DOCUMENTS

| | | | | |
|---|---|---|---|---|
| 6,715,671 | B2 | 4/2004 | Abe et al. | |
| 2003/0075487 | A1 | 4/2003 | Abe et al. | |
| 2014/0318925 | A1* | 10/2014 | Lee | G07F 19/202 194/206 |
| 2015/0371480 | A1* | 12/2015 | Luo | G07D 11/0018 271/1 |
| 2015/0379799 | A1* | 12/2015 | Kim | G07F 19/20 194/350 |
| 2016/0122149 | A1* | 5/2016 | Luo | B65H 31/24 206/449 |
| 2016/0355360 | A1* | 12/2016 | Shin | B65H 5/06 |

* cited by examiner

METHOD FOR HANDLING SHEET MATERIAL

BACKGROUND

The present invention concerns a method for handling sheet goods, in particular value documents, such as bank notes, and a container for sheet goods, in particular for value documents, such as bank notes. The sheet-goods container may be in particular a bank-note cassette. The invention furthermore concerns an apparatus for processing sheet goods with the sheet-goods container or bank-note cassette, in particular a bank-note machine.

In an apparatus for processing sheet goods, for example a bank-note machine which is provided for inputting and outputting bank notes, different kinds of bank-note containers can be employed. Depending on the case of application, different bank-note containers can be inserted in the bank-note machine, which are intended for receiving bank notes (so-called deposit cassettes or deposit stores) or for outputting bank notes (so-called dispense cassettes or dispense stores). Dispense cassettes are inserted into the bank-note machine in a filled state, for example, in each case a cassette with bank notes of a certain denomination.

When a bank note is drawn out of a dispense cassette, a malfunctioning of the singler of the cassette can lead to an unwanted double or multiple pick, whereby two or more bank notes are drawn simultaneously. Double and multiple picks often lead to a standstill of the bank-note machine, since they either, for example, fan out and thereby cause a jam in the transport system, or else, if they are recognized by a corresponding check in time after being drawn, are left in the transport system to be removed manually. Double or multiple picks can also be conveyed into a separate pocket in the bank-note machine in order to avoid a standstill of the machine. However, this can lead to an indeterminacy of the fill quantity of the bank-note cassette, if it cannot be established how many bank notes were drawn simultaneously. In other words, the stock reliability of a bank-note cassette can in this way not be guaranteed.

SUMMARY

The object of the present invention is hence to improve the handling of double or multiple picks in an apparatus for processing sheet goods.

This object is achieved by a method for handling sheet goods, a container for sheet goods, and an apparatus for processing sheet goods with such a container, having the features of the independent claims. Developments and advantageous embodiments thereof are stated in claims dependent thereon.

In a method according to the invention for handling sheet goods, in particular value documents, such as bank notes, in an apparatus for processing sheet goods, in particular value documents, such as bank notes, sheet goods removed from a container which is inserted in the apparatus are checked for further processability and, in the case of a negative check result, are returned into the container. The returning of the removed sheet goods is effected through an input opening of the container which is separate from an output opening of the container.

The removed sheet goods that have been recognized as not further processable are therefore fed to the container at a different place from the place from which they were removed and do not hinder sheet goods located in the container from being further removed. In particular, sheet goods that are received in the container in the form of a sheet-goods stack remain capable of being singled. The stock reliability of the container is guaranteed, since removed sheet goods are returned into the container and do not remain outside the container.

The check for further processability can comprise in particular the check for a double or multiple pick. In other words, it is checked whether two or more sheet-goods items, for example bank notes, have inadvertently been drawn simultaneously. However, the check for further processability can also comprise a check for authenticity, denomination, state, and/or type, such as currency of a bank note. A negative check result upon the check for further processability means that the sheet goods removed from the container cannot be further processed and therefore means, in particular, the detecting of a multiple pick (including a double pick) or, for example, the detecting of a counterfeit bank note, a bank note of a foreign currency or a bank note with a denomination that should not belong in the container, and the like.

Preferably, the removed sheet goods, in the case of a negative check result, are returned through the input opening into a sheet-goods region of the container from which the sheet goods were also removed, so that the sheet goods are removable again through the output opening of the container. In particular sheet goods that were part of a multiple pick can in this manner be singled out of the container again at a later time.

Preferably, the sheet goods are removed from a sheet-goods stack received in the container from a first side of the sheet-goods stack, and fed back to the sheet-goods stack on a second side of the sheet-goods stack opposing the first side when being returned into the container. The input opening and the output opening of the container are for this purpose configured separately and spaced apart along a height of the container. For example, the sheet goods can be removed from a lower end of a sheet-goods stack and fed back to the sheet-goods stack at its upper end. Even in the case of an improper returning of sheet goods into the container, the sheet goods already located in the container then still remain capable of being singled, so that no standstill of the apparatus occurs, for example. The sheet goods returned into the container are then outputted again last.

If the sheet goods that have caused the negative check result are not to be outputted again, the removed sheet goods can be returned into a sheet-goods region of the container that is separate from the sheet-goods region of the container from which the sheet goods are removable. For example, the container can comprise a separate pocket which is adapted only for depositing sheet goods and not for removing sheet goods. For example, sheet goods for which the check for authenticity, currency, denomination or state delivered a negative check result can be deposited in the container in this manner. The stock reliability of the container is guaranteed in this case as well, since the removed sheet goods are returned into the container.

It is accordingly also possible to return the sheet goods that are not further processable, depending on the kind of the negative check result, either into the separate sheet-goods region, for example, in the case of a counterfeit bank note, or into the same sheet-goods region, for example, in the case of a multiple pick.

A corresponding container for sheet goods, in particular for value documents, such as hank notes, that is suitable for the described method therefore comprises an input opening for inputting sheet goods into the container and an output opening for outputting sheet goods received in the container, wherein the input opening and the output opening are mutually separate and spaced apart along a height of the container. The container furthermore comprises a pressing device which limits at least a first sheet-goods region in the container and which is displaceable along the height of the container and is adapted to urge sheet goods located in the sheet-goods region in the direction of the output opening.

To make it possible that sheet goods removed from the container and returned into the container can be outputted from the container again, the pressing device is preferably displaceable past the input opening such that the sheet goods are both outputtable from the first sheet-goods region through the output opening and inputtable into the first sheet-goods region through the input opening. For example, in the case of a multiple pick, where the corresponding sheet goods are to be outputted again later, the pressing device can be moved within the container such that the removed sheet goods are returnable into the same sheet-goods region from which they were removed. Preferably, as described hereinabove, the sheet goods are removed from a first side of a sheet-goods stack and fed back to the sheet-goods stack on an opposing side of the sheet-goods stack.

If the removed and returned sheet goods are not to be outputted again, as in the stated cases of authenticity defects, wrong currency, wrong denomination or unfit state, the sheet goods can be deposited in a region of the container that is not intended for outputting sheet goods. For this purpose, the pressing device can define a second sheet-goods region and divide the container into first and second sheet-goods regions. The first sheet-goods region can be located on a side of the pressing device on which the output opening is also located, whereas the second sheet-goods region can be located on a side of the pressing device on which the input opening is located when the pressing device is accordingly positioned. For this purpose, the pressing device can be shifted accordingly, so that the sheet goods are inputtable into the second sheet-goods region through the input opening.

The shifting of the pressing device can be effected, for example, by at least one electric motor which is adapted to shift the pressing device along the height of the container. Alternatively, the pressing device can, for example, also be shifted by a mechanical spring apparatus. Advantageously, a pressure in the direction of the output opening is supplied which ensures a singling of the sheet goods. Preferably, the output opening of the container has associated therewith a singler which is adapted to single sheet goods out of the container and output them through the output opening.

Further preferably, the container comprises a storage device for storing data relating to sheet goods received in the container. The data can comprise, for example, the number, value, denomination or other data about the stock of sheet goods. A stock reliability is guaranteed by the method and container according to the invention, since in the case of an indeterminate removal, for example, a multiple pick, the unknown quantity of sheet goods is returned into the container and does not remain outside the container. In other words, the data on the storage device will match the actual status in the container.

A corresponding apparatus for processing sheet goods comprises at least one transport path for transporting sheet goods and at least one container as described above, wherein the transport path can transport sheet goods from the output opening of the container to the input opening of the container. The apparatus is adapted to carry out the above-described method for handling sheet goods.

Preferably, a checking device is thus provided in the apparatus in order to check sheet goods removed from the container for further processability. In the case of a negative check result, the removed sheet goods are fed back to the input opening of the container via the transport path. The check for further processability can take place during or after the output of sheet goods. It is preferred that the checking device is located near the container so that sheet goods that are not further processable are transported only a short stretch in the transport path so as to avoid, for example, a jam caused by a multiple pick fanning out.

Further advantages, features and details of the invention will result from the following detailed description, in which exemplary embodiments of the invention will be described in detail with reference to the drawings. The features mentioned in the claims and in the description may be essential to the invention individually per se or in arbitrary combination. Likewise, the features recited above and those recited below may be employed each per se or in groups in arbitrary combinations. Functionally similar or identical members or components are furnished in part with the same reference signs. The terms "left", "right", "above" and "below" employed in the description of the embodiment examples relate to the drawings as oriented with the figure designation or reference signs in the normally legible way. The shown and described embodiments are not to be understood as exhaustive, but have an exemplary character for explaining the invention. The detailed description is for the skilled person's information, so that known circuits, structures, and methods are not shown or explained in detail in the description so as not to impede the understanding of the present description.

BRIEF DESCRIPTION OF THE DRAWINGS

The invention will hereinafter be explained by way of example with reference to the attached schematic drawings. Therein are shown.

DETAILED DESCRIPTION

Figure 1:
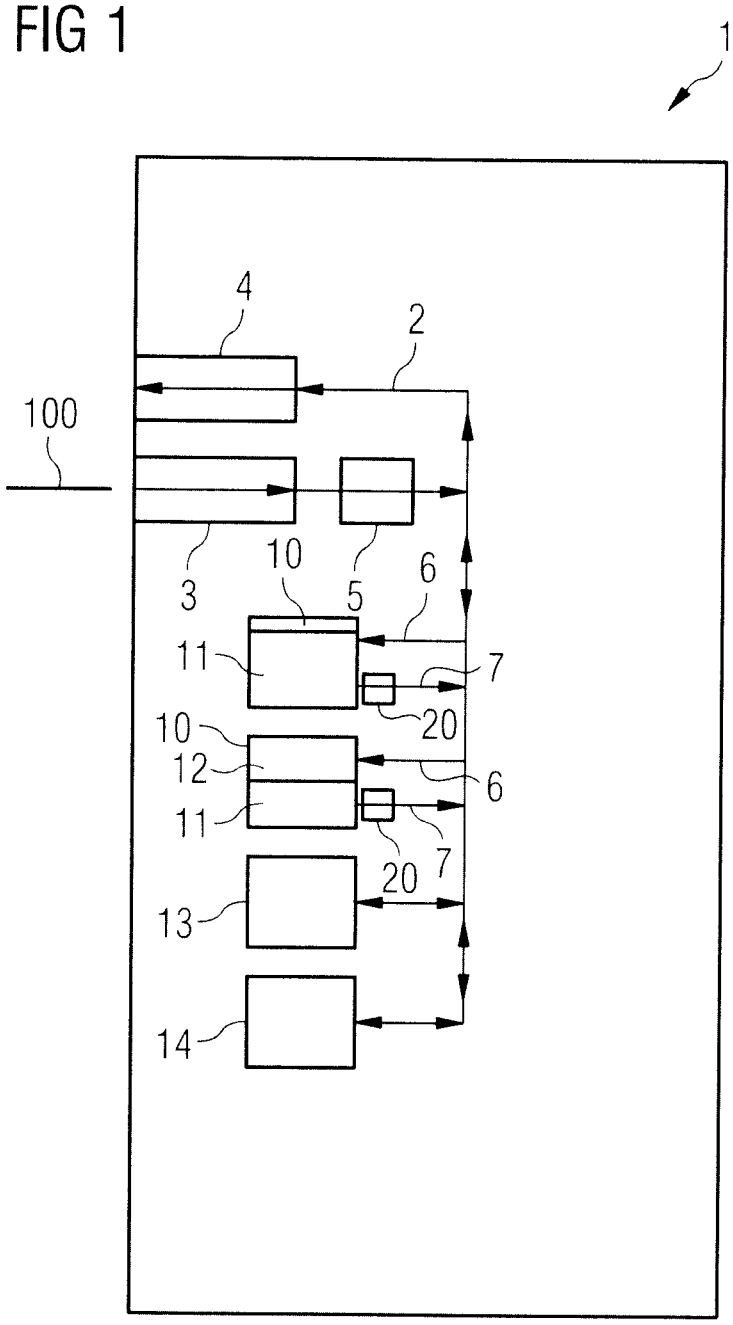
FIG. 1: An apparatus for processing sheet goods, in particular a bank-note machine.

In FIG. 1 is represented an apparatus for processing sheet goods in the form of a bank-note machine 1. The drawing is only intended to schematically represent individual components of the bank-note machine 1 and their functional connection with each other. It will be appreciated that the bank-note machine 1 can have further and/or other components. The bank-note machine 1 has an input 3, such as an input pocket for abank-note stack or afeeder for individual bank notes 100, to which a user can input one or more bank notes 100. For paying out, the machine 1 has an output 4 from which the user can remove bank notes 100. The output 4 can be configured like the input 3 as a pocket or slot in the known manner. After a bank note 100 is inputted, it is checked in an input checking device 5 for denomination, authenticity, state and/or further features before being passed to the transport path 2. Via the transport path 2, which can contain in particular rails, transport rollers and gates in the known manner, an inputted bank note can be passed to different stores or containers. To be paid out, bank notes 100 can be outputted from corresponding stores or containers via the transport path 2.

In the schematic exemplary embodiment shown in FIG. 1, the bank-note machine 1 comprises two bank-note containers 10 according to the invention having a first sheet-goods region 11, e.g., a dispense region, for outputting bank notes 100 and, where applicable, a second sheet-goods region 12, e.g., a deposit region, for receiving bank notes 100. A transport-path portion 6 leads to the container 10, in particular to an input opening 17, as explained further in FIGS. 2 and 3, while a transport-path portion 7 leads away from the container 10, in particular from an output opening 16. In the transport-path portion 7 there is provided an output checking device 20 which checks removed bank notes 100 for further processability, in particular for a multiple pick, but also for other features, where applicable, such as authenticity or denomination. In the case of a negative check result, for example, if a multiple pick is detected, whereby two or more bank notes 100 have been drawn simultaneously, the corresponding bank notes 100 are returned via the respective transport paths 2, 6, 7 to the container 10, namely, to the input opening 17 of the container 10, separate from the output opening 16. The upper one of the two containers 10 is represented in a state in which removed bank notes 100 are being returned into the same region 11 of the container 10 from which they were removed, in order to enable a new outputting (illustrated in FIG. 3). The lower one of the two containers 10, in contrast, is represented in a state in which the bank notes 100 are being returned into a second sheet-goods region 12 of the container 10 and cannot be outputted again (illustrated in FIG. 2).

Furthermore, the bank-note machine 1 of FIG. 1 has an intermediate store 13 and a deposit cassette 14, The deposit cassette 14 serves for finally depositing bank notes 100, whereas the intermediate store 13 serves for temporarily receiving bank notes 100. For example, bank notes 100 inputted by a user are first stored in the intermediate store 13 in order to be outputtable again, for example, in the case of an abort of the operation. This function of the intermediate store 13 is also designated "escrow." Further, it may be expedient to keep some bank notes 100 available in the intermediate store 13 for subsequent operations, for example in order to accelerate payouts. This function of the intermediate store 13 is designated "recycler." The intermediate store 13 is preferably configured as a film-type store. In this basically known type, which accordingly is not illustrated, bank notes 100 are wound between two films onto a reel in the order of their input and can be outputted again in the reverse order by unwinding the reel.

Figure 2:
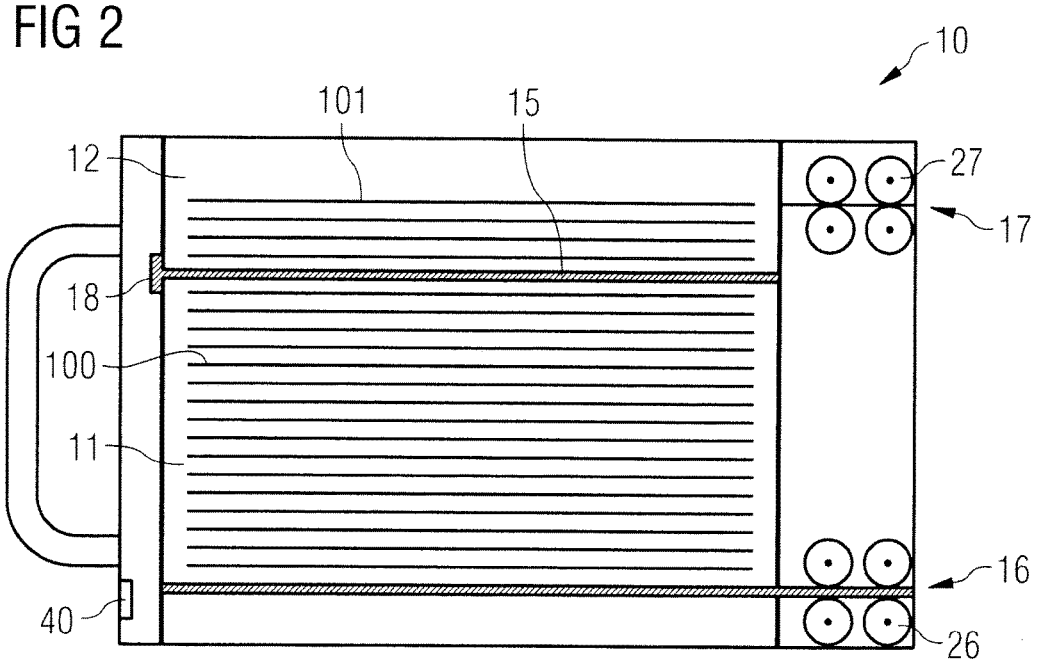
FIG. 2: A container for sheet goods, in particular a bank-note cassette, in a first state.

FIG. 2 shows a container 10 for sheet goods, in particular bank notes 100. The represented container 10 is in particular a bank-note cassette, such as a dispense cassette, which is inserted into a bank-note machine 1 in a filled state. The container 10 thus comprises an output device 26, such as a singler, associated with the output opening 16, for outputting bank notes 100 that are received in stack form in a first sheet-goods region 11 of the container 10. A pressing device 15, in particular in the form of a separating panel, is provided to urge the bank-note stack in the direction of the lower panel of the container 10, in particular in the direction of the output opening 16, to enable or simplify a singling of the bank notes 100. The pressing device 15 separates the container 10 into the first sheet-goods region 11 and a second sheet-goods region 12. The second sheet-goods region 12 serves for depositing bank notes 101 that are introduced into the second sheet-goods region via an input device 27 associated with the input opening 17. The bank notes 101 introduced via the input device 27 are ones that were previously removed from the first sheet-goods region 11 and, upon a check for further processability, recognized as not being further processable. The bank notes 101 are returned into the second sheet-goods region 12 of the container 10 in order to ensure the stock reliability of the container 10. The bank notes 101 located in the second sheet-goods region 12 can no longer be outputted from the container 10. At the same time, the bank notes 100 in the first sheet-goods region 11 still remain capable of being singled via the output device 26. There is thus avoided a standstill for remedying and removing the bank notes 100 that are not further processable. A data storage unit 40 serves for storing data relating to the bank notes 100 received in the container 10.

Instead of the bank notes 100 being returned through the input opening 17, the bank notes 100 can alternatively be stamped into the second sheet-goods region 12 of the container 10 from above, as is common practice with deposit cassettes.

The pressing device 15 is displaceable along the height of the container 10. For example, the pressing device 15 can be moved along the height of the container 10 by one or more electric motors 18. Thus, a continuous and sufficient pressure on the sheet-goods stack in the direction of the output opening 16 can be guaranteed.

Figure 3:
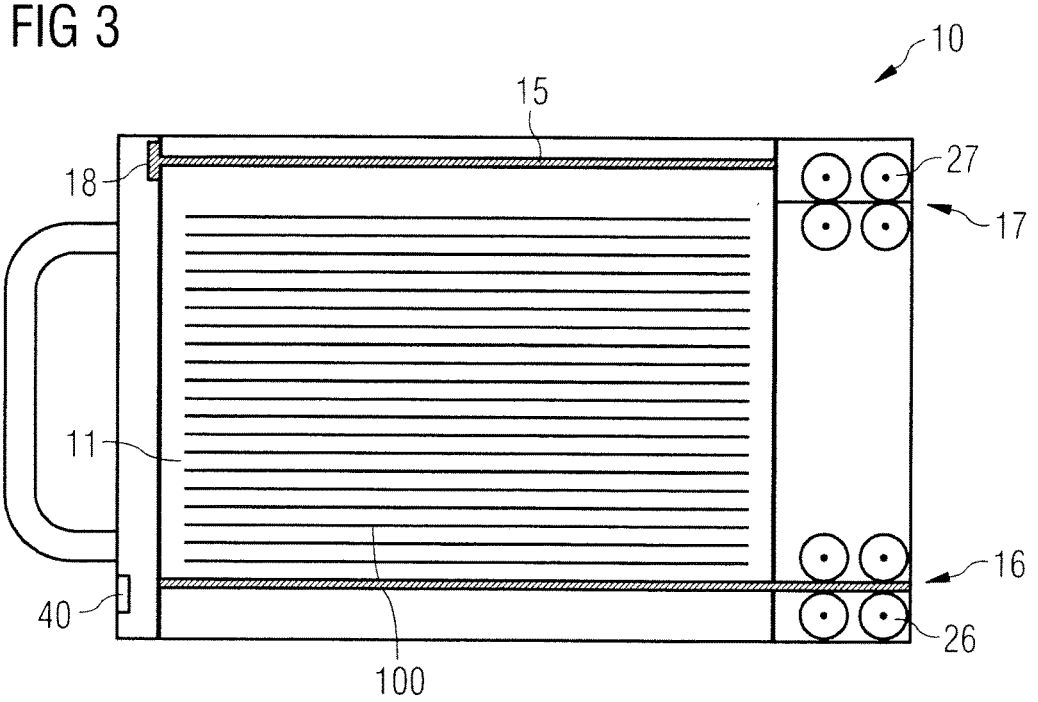
FIG. 3: The container of FIG. 2 in a second state.

As represented in FIG. 3, the pressing device 15 can also be shifted past the input opening 17 in the direction of the upper end of the container 10. Through the input opening 17, bank notes 100 can now also be inputted into the first sheet-goods region 11. In particular, bank notes 100 can be deposited onto the upper end of the stack located in the first sheet-goods region 11, while bank notes 100 can still be drawn from the lower end of the stack by the output device 26. In the case of a detected multiple pick, for example, the corresponding bank notes 100 can be fed back to the first sheet-goods region 11 and be outputted again through the output opening 16 at a later time.

The handling of multiple picks is therefore simplified, since multiple picks need not be removed from the bank-note machine 1 manually, but are simply returned into the container 10. However, since the bank notes 100 are returned into the container 10 through the input opening 17 which is located at a different place from the output opening 16, being in particular separate therefrom and spaced apart along the height of the container 10, the output of bank notes 100 already located in the container is not disturbed.

The invention claimed is:

1. A method for handling sheet goods, in particular value documents, in an apparatus for processing sheet goods, in particular a bank-note machine, comprising:

removing sheet goods from an output opening of a container in the apparatus, checking the removed sheet goods for further processability, in a case of a negative check result, returning the sheet goods into the container through an input opening of the container that is separate from the output opening, wherein a pressing device displaceable along a height of the container divides the container into first and second sheet goods regions, which are separate from one another, and wherein the removed sheet goods, in the case of a negative check result, are returned into the first or second sheet-goods regions of the container depending on a kind of negative check result, namely:

in a case of a first kind, the sheet goods are returned through the input opening into the first sheet-goods region of the container from which the sheet goods were removed, so that the returned sheet goods are removable again through the output opening and, in a case of a second kind, the sheet goods are returned through the input opening or through another input opening into the second sheet-goods region of the container, from which the sheet goods were removed.

2. The method according to claim 1, wherein the sheet goods are removed from a sheet-goods stack received in the container through the output opening from a first side of the sheet-goods stack and are fed through the input opening back to the sheet-goods stack on a second side of the sheet-goods stack opposing the first side when being returned into the container.

3. The method according to claim 1, wherein the sheet goods are singled when being removed from the container and checking for further processability comprises a check for a multiple pick, authenticity, and/or denomination of the sheet goods.

4. The method according to claim 1, wherein the first kind of negative check result concerns a multiple pick and the second kind of negative check result concerns authenticity, denomination, state, and/or type of the removed sheet goods.

5. A container for sheet goods, in particular for value documents, the container comprising:

an input opening for inputting sheet goods into the container and an output opening for outputting sheet goods from the container, wherein the input opening and the output opening are mutually separate and spaced apart along a height of the container; and a pressing device which limits at least a first sheet-goods region in the container and which is displaceable along the height of the container and adapted to urge sheet goods located in the first sheet-goods region in a direction of the output opening, wherein the pressing device is displaceable past the input opening such that sheet goods are both outputtable from the first sheet-goods region through the output opening and inputtable into the first sheet-goods region through the input opening, and wherein the pressing device furthermore limits a second sheet-goods region and divides the container into the first sheet-goods region and the second sheet-goods region and wherein the pressing device is displaceable such that sheet goods are inputtable into the second sheet-goods region through the input opening.

6. The container according to claim 5, wherein the input opening and the output opening are arranged such that sheet goods are removable through the output opening from a first side of a sheet-goods stack received in the container and are feedable through the input opening to a second side of the sheet-goods stack opposing the first side.

7. The container according to claim 5, the container further comprising at least one electric motor to shift the pressing device along the height of the container.

8. An apparatus for processing sheet goods, in particular value documents, such as bank notes, the apparatus comprising:

at least one transport path for transporting sheet goods, and at least one container, wherein the container comprises:

an input opening for inputting sheet goods into the container and an output opening for outputting sheet goods from the container, wherein the input opening and the output opening are mutually separate and spaced apart along a height of the container; and a pressing device which limits at least a first sheet-goods region in the container and which is displaceable along the height of the container and adapted to urge sheet goods located in the first sheet-goods region in a direction of the output opening, wherein the pressing device is displaceable past the input opening such that sheet goods are both outputtable from the first sheet-goods region through the output opening and inputtable into the first sheet-goods region through the input opening, and wherein the pressing device furthermore limits a second sheet-goods region and divides the container into the first sheet-goods region and the second sheet-goods region and wherein the pressing device is displaceable such that sheet goods are inputtable into the second sheet-goods region through the input opening, wherein the transport path is adapted to transport sheet goods from the output opening of the container to the input opening of the container.

9. The apparatus according to claim 8, further comprising a checking device to check sheet goods removed from the container for further processability during or after the output of sheet goods through the output opening of the container, wherein the apparatus is adapted to feed the removed sheet goods to the input opening of the container via the transport path in a case of a negative check result.

* * * * *